US006112919A

United States Patent [19]

Ho

[11] Patent Number: 6,112,919

[45] Date of Patent: Sep. 5, 2000

[54] LEAKAGE PREVENTIVE DEVICE FOR MILK BOTTLES OR THE LIKE

[76] Inventor: Shu-E Ho, 5 FL. No. 85, Chung Ching Rd., Pan Chiao City, Taipei County, Taiwan

[21] Appl. No.: 09/114,279

[22] Filed: Jul. 13, 1998

[51] Int. Cl.[7] ..... A61J 9/00; A61J 11/00

[52] U.S. Cl. ..... 215/11.4; 215/11.1; 215/11.5; 220/714

[58] Field of Search ..... 215/11.1, 11.4, 215/11.5; 220/714

[56] References Cited

U.S. PATENT DOCUMENTS

| | | | |
|---|---|---|---|
| 990,662 | 4/1911 | MacGlashan | 215/11.4 |
| 2,672,124 | 3/1954 | McCrary | 215/11.4 X |
| 2,764,155 | 9/1956 | Meyers | 215/11.4 |
| 3,323,669 | 6/1967 | Yazaki | 215/11.1 |
| 3,704,803 | 12/1972 | Ponder | 215/11.4 X |
| 4,640,424 | 2/1987 | White | 215/11.4 X |
| 4,687,466 | 8/1987 | Larson | 215/11.4 X |
| 4,969,564 | 11/1990 | Cohen et al. | 215/11.4 X |
| 5,295,597 | 3/1994 | Green | 215/11.4 |
| 5,354,274 | 10/1994 | Demeter et al. | 215/11.1 X |
| 5,779,071 | 7/1998 | Brown et al. | 215/11.1 X |
| 5,890,621 | 4/1999 | Bachman et al. | 215/11.4 X |

FOREIGN PATENT DOCUMENTS

| | | | |
|---|---|---|---|
| 384394 | 8/1990 | European Pat. Off. | 215/11.1 |
| 2139903 | 11/1984 | United Kingdom | 215/11.1 |

*Primary Examiner*—Sue A. Weaver
*Attorney, Agent, or Firm*—Dougherty & Troxell

[57] ABSTRACT

A leakage preventive device is provided for use on a milk bottle or the like to help prevent the milk contained in the bottle from leaking out when the bottle falls aside or is subjected to violent shaking. The leakage preventive device comprises: a mounting device having a cylindrical body formed with a hollowed inside serving as a passage for the liquid contained in the bottle; and an elastic valve member mounted on the mounting device. The elastic valve member is formed with a thick outer wall, which can be fitted tightly to the outer wall of the cylindrical body of the mounting device, and a substantially U-shaped inner ring, which can be linked to the outer wall. The U-shaped inner ring is made from an elastic material, allowing the U-shaped inner ring to urge forcibly against the inner wall of the cylindrical body when the teat is not being sucked; the U-shaped inner ring having an open end to define a chamber connected to the teat. When the teat is being sucked, it causes a negative air pressure to cause the U-shaped inner ring to be compressed inwards, thereby allowing a gap between the U-shaped inner ring and the inner wall of the cylindrical body to allow the liquid in the bottle to flow therethrough to the teat.

9 Claims, 4 Drawing Sheets

LEAKAGE PREVENTIVE DEVICE FOR MILK BOTTLES OR THE LIKE

BACKGROUND OF THE INVENTION

1. Field of the Invention

This invention relates in general to a leakage preventive device for use on a milk bottle or the like to prevent the milk in the bottle from leaking out.

2. Description of Related Art

A baby milk bottle typically includes a teat secured by a ring on the top opening of the bottle. The teat is customarily made from a soft, flexible material with a small hole for the baby to suck the milk contained in the bottle. In use, however, the milk in the bottle can leak out of the bottle through the hole of the teat when the bottle falls aside or is subjected to violent shaking, which would cause taints to the nearby furniture, clothing, or bedding.

In view of the foregoing problem, various leakage preventive devices have been provided to milk bottles so as to prevent leakage of the milk out of the bottle.

One conventional leakage preventive device for milk bottle includes a teat which is formed with a chamber with a large inside space near the sucking hole, and an elastic ring mounted in the chamber. The wall of the chamber is constricted near the bottom that allows the teat to be fastened to the bottle. The ring is made from an elastic material. When the ring is accommodated in the chamber of the teat, it is urged forcibly by the constricted portion of the chamber against the inner wall of the teat, thereby preventing the milk in the bottle from leaking out. When the baby sucks the teat, a gap can be formed between the ring and the inner wall of the chamber, thereby allowing the milk in the bottle to flow through the gap to the baby's mouth.

There are, however, some drawbacks to the above-mentioned prior art. First, since the chamber is relatively spacious and provided near the sucking hole of the teat, dust and bacteria can easily grow there, which can be sucked along with the milk into the baby's body. Moreover, the elastic ring is too tightly mounted in the teat which makes it hard to remove for cleaning. Second, when a baby sucks the teat for milk, it requires the baby to suck forcibly in order to make the gap between the ring and the inner wall of the teat to allow the milk to flow therethrough into the baby's mouth. It is therefore quite wearisome for the baby to drink milk from the bottle with the conventional leakage preventive device. Third, the elastic ring can easily loosen out of position from the teat after a long period of use due to fatigue of the elastic property thereof This can cause a large opening in the teat, making the teat unusable.

SUMMARY OF THE INVENTION

It is therefore an objective of the present invention to provide a leakage preventive device for a milk bottle or the like, which can help prevent the milk from leaking out of the bottle when the bottle falls aside or is subjected to violent shaking.

It is another objective of the present invention to provide a leakage preventive device for a milk bottle or the like, which allows the baby to effortlessly suck the milk into the mouth.

It is still another objective of the present invention to provide a leakage preventive device for a milk bottle or the like, which can prevent dust and bacteria from growing in the teat where the leakage preventive device is installed.

It is yet another objective of the present invention to provide a leakage preventive device for a milk bottle or the like, whose constituent parts can all be dismantled whenever it is desired to clean the milk bottle.

It is still yet another objective of the present invention to provide a leakage preventive device for a milk bottle or the like, which allows the milk bottle to be usable even when the leakage preventive device is removed.

In accordance with the foregoing and other objectives of the present invention, a leakage preventive device for a milk bottle or the like is provided. The leakage preventive device of the invention is designed for use on a bottle having a teat for the purpose of preventing liquid in the bottle from leaking out. The leakage preventive device of the invention comprises: a mounting device disposed between the bottle and the teat, the mounting device including a cylindrical body having a hollowed inside serving as a passage for the liquid contained in the bottle; and an elastic valve member mounted on the mounting device. The elastic valve member has an outer wall, which can be fitted tightly to the outer wall of the cylindrical body of the mounting device; and a substantially U-shaped inner ring, which can be linked to the outer wall. The top face of the elastic valve member is formed with a plurality of vents which allow the liquid passing through the hollowed inside of the cylindrical body of the mounting device to pass therethrough to the hole of the teat. The U-shaped inner ring is made from an elastic material, allowing the U-shaped inner ring to urge forcibly against the inner wall of the cylindrical body when the teat is not being sucked. The U-shaped inner ring has an open end to define a chamber connected to the teat. When the teat is being sucked, it causes a negative air pressure to cause the U-shaped inner ring to be compressed inwards, thereby allowing a gap between the U-shaped inner ring and the inner wall of the cylindrical body to allow the liquid in the bottle to flow therethrough to the teat.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

Figure 1:
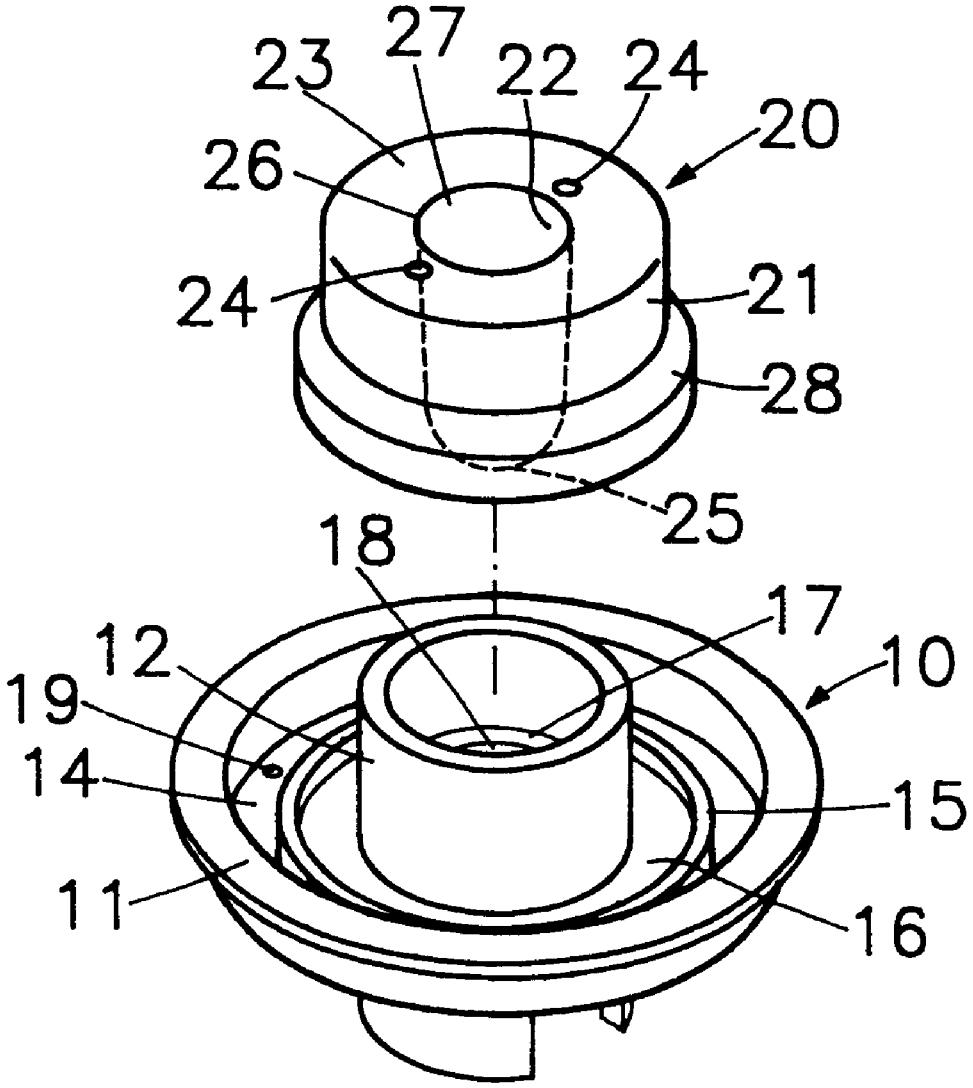
FIG. 1 is an exploded perspective view of the leakage preventive device of the invention.
Figure 2:
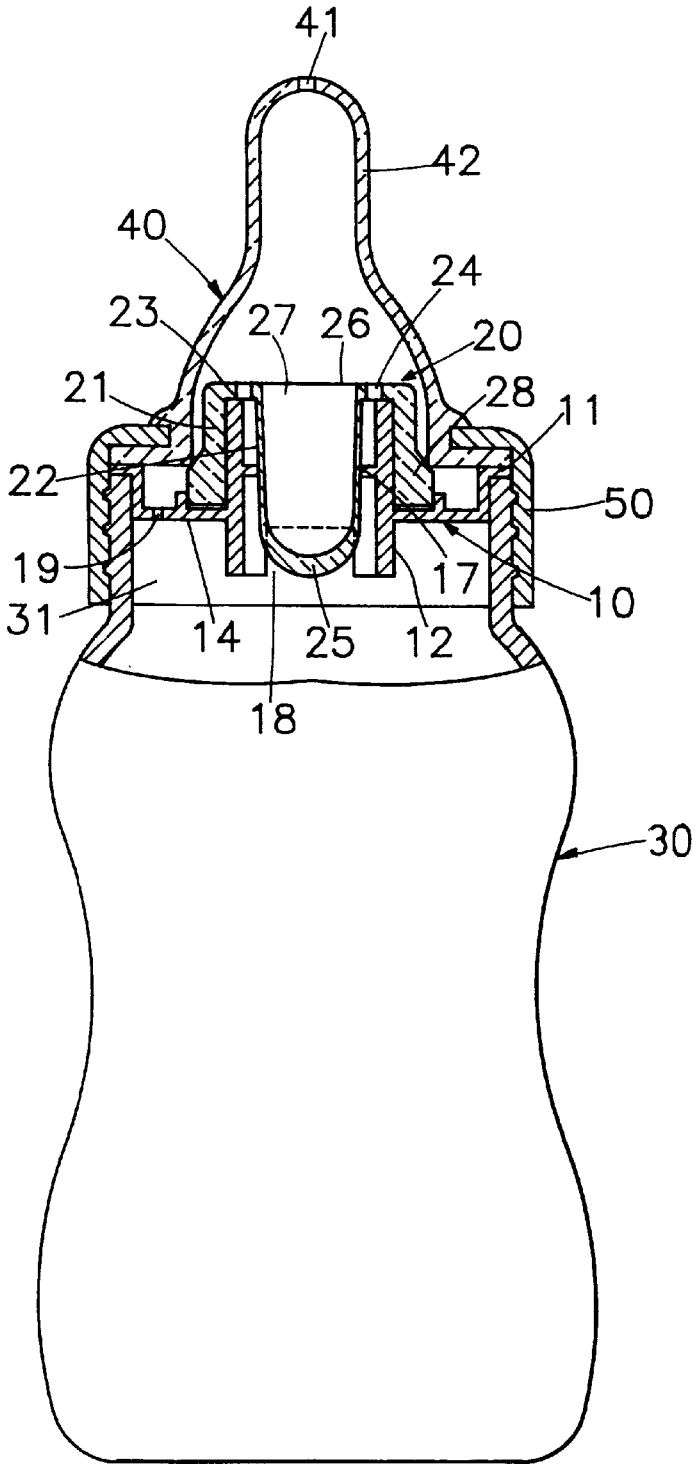
FIG. 2 is a side view partially broken away, of a milk bottle utilizing the leakage preventive device of the of FIG. 1.

Referring to FIGS. 1 and 2, the leakage preventive device of the invention is provided for use on a milk bottle 30 with a teat 40. The leakage preventive device includes mainly a mounting device 10 and an elastic valve member 20. The mounting device 10 is disposed between the bottle 30 and the teat 40; and the elastic valve member 20 can be tightly fitted over the mounting device 10.

The teat 40 includes a ring 50 having inner threaded portion that can be screwed to the outer threaded portion near the top 31 of the bottle 30 so as to mount the teat 40 on the bottle 30. The teat 40 or the ring 50 is formed with vent means (not shown) that allows the atmospheric air to be introduced into the inside of the bottle 30 when a baby is sucking the teat 40. The vent means is a conventional structure so description thereof will not be further detailed.

The mounting device 10 is formed with a circular lip 11 and a cylindrical body 12 linked via a linking portion 14 to the circular lip 11. The linking portion 14 is substantially L-shaped in cross section. Further, a circular protruded portion 15 is formed over the linking portion 14 to define a recessed portion 16 between the circular protruded portion 15 and the cylindrical body 12. A circular skirt portion 17 is formed on the inner wall of the hollowed cylindrical body 12, which defines a valved passage 18 between the bottle 30 and the teat 40. A vent 19 is formed in the linking portion 14 to allow the atmospheric air to be introduced therethrough into the bottle 30 when the baby is sucking the teat 40 for milk. Alternatively, the vent 19 can be formed in the circular lip 11 or as a separate device in accordance with various design choices.

The elastic valve member 20 is made from an elastic, nontoxic, and soft material. Preferably, the elastic valve member 20 and the teat 40 are made from the same material. The elastic valve member 20 has a thick outer wall 21, which can be fitted tightly to the cylindrical body 12; and a thin and substantially U-shaped inner ring 22, which can be linked via the top face 23 to the outer wall 21. The outer wall 21 is further formed with a tapered bottom 28 which can be fitted tightly into the recessed portion 16 in the mounting device 10, allowing the elastic valve member 20 to be coupled to the mounting device 10. When coupled, the tapered bottom 28 is abutted on the bottom of the teat 40. When the U-shaped inner ring 22 is subjected to no external force (i.e., when the teat 40 is not being sucked), its outer diameter is smaller than the inner diameter of the hollowed inside of the cylindrical body 12 but greater than the inner diameter of the circular skirt portion 17. As a result, the U-shaped inner ring 22 can exert forcibly on the circular skirt portion 17, causing the valved passage 18 between the bottle 30 and the teat 40 to be closed, as illustrated in FIG. 2. Moreover, it allows the forming of a gap between the U-shaped inner ring 22 and the inner wall of the cylindrical body 12. Further, a plurality of vents 24 are formed in the top face 23 of the elastic valve member 20, which allow milk to flow therethrough when the U-shaped inner ring 22 is moved away from the circular skirt portion 17. The U-shaped inner ring 22 has a closed bottom end 25 and an open top end 26 to define a chamber 27 therebetween.

As shown in FIG. 2, when the teat 40 is not being sucked, the U-shaped inner ring 22 expands outwards to urge against the circular skirt portion 17 of the cylindrical body 12 due to its elasticity, thereby closing the valved passage 18 between the bottle 30 and the teat 40. As a result, the milk in the bottle 30 can be prevented from leaking out through the hole 41 of the teat 40 to the outside.

Figure 3:
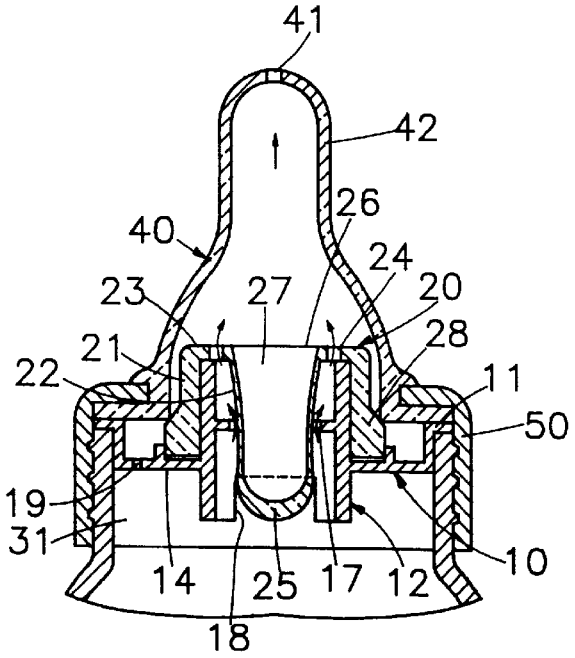
FIG. 3 is a cross-sectional side view of the leakage preventive device of the invention when the teat of the milk bottle is being sucked.

As shown in FIG. 3, when the baby sucks the protruded portion 42 of the teat 40, it can cause a negative air pressure in the teat 40 and the chamber 27, thereby causing the U-shaped inner ring 22 to be compressed inwards. As a result of this, a passage is formed between the U-shaped inner ring 22 and the circular skirt portion 17 of the cylindrical body 12, which allows the milk in the bottle 30 to flow through the passage and onwards through the vents 24 and the hole 41 of the teat 40 to the baby's mouth, as indicated by the arrows in FIG. 3. When the baby pauses or stops the sucking action, the compressed U-shaped inner ring 22 can restore to its original shape due to its elastic property, thereby causing the valved passage 18 to be closed again to prevent the milk in the bottle 30 from leaking out.

In one preferred embodiment, the closed bottom end 25 of the U-shaped inner ring 22 is formed in such a manner as to be greater in thickness than the two side walls of the U-shaped inner ring 22. This design allows the negative air pressure caused by the sucking action of the baby to first cause the thinner side walls to be compressed inwards, thus allowing the valving action to be more reliable.

Figure 4:
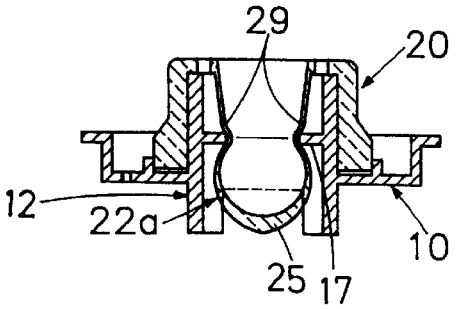
FIG. 4 is a cross-sectional side view of a second preferred embodiment of the leakage preventive device of the invention.

FIG. 4 is a schematic side view of a second preferred embodiment of the leakage preventive device of the invention. The second preferred embodiment differs from the previous one only in that the U-shaped inner ring, here designated by the reference numeral 22*a*, is formed in such a manner as to make the two side walls thereof substantially S-shaped, as designated by the reference numeral 29, with the closed bottom end 25 being formed into a circular shape. This makes the part of the S-shaped side walls 29 that comes into abutment on the circular skirt portion 17 to be recessed. When the U-shaped inner ring 22*a* is subjected to a negative air pressure caused by the baby's sucking action, the U-shaped inner ring 22*a* will be compressed first at the central recessed portion. This allows the valving action to be more reliable.

Figure 5:
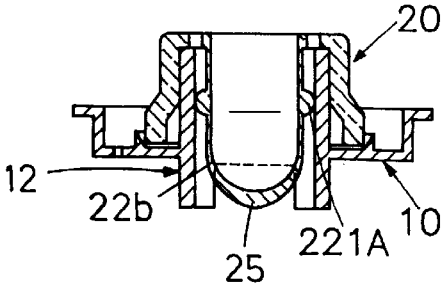
FIG. 5 is a cross-sectional side view of a third preferred embodiment of the leakage preventive device of the invention.

FIG. 5 is a schematic side view of a third preferred embodiment of the leakage preventive device of the invention. This embodiment differs from the previous two only in that a circular protruded portion 221A is formed around the outer wall of the U-shaped inner ring 22*b*, and that the circular skirt portion 17 in the previous embodiments is here eliminated. The circular protruded portion 221A allows a gap to be formed between the U-shaped inner ring 22*b* and the inner wall of the cylindrical body 12. This can also provide the desired valving action for the milk bottle.

Figure 6:
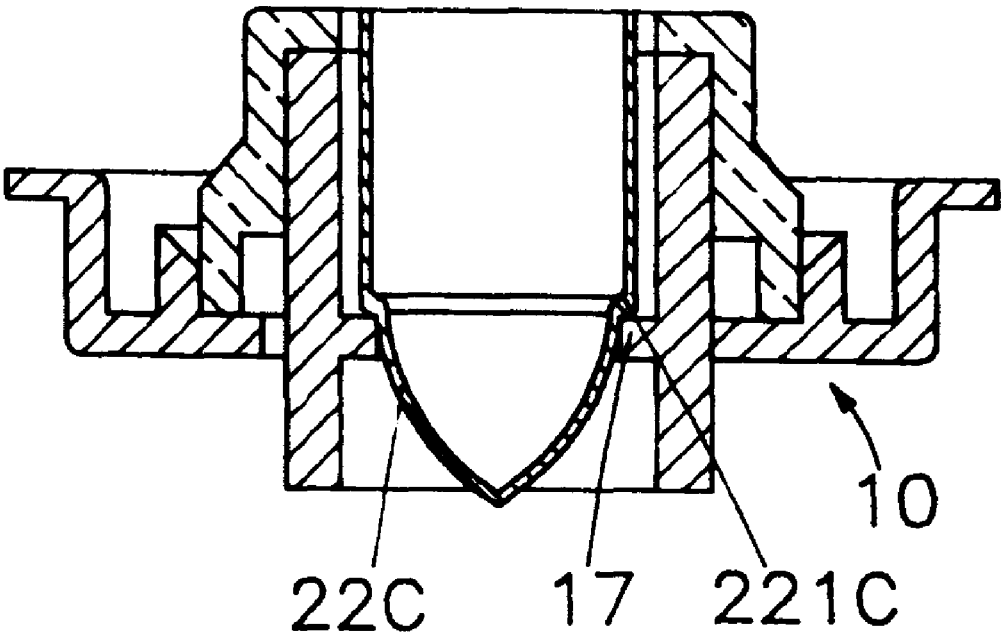
FIG. 6 is a cross-sectional side view of a fourth preferred embodiment of the leakage preventive device of the invention.

FIG. 6 is a schematic side view of a fourth preferred embodiment of the leakage preventive device of the invention. This embodiment differs from the previous ones only in that the U-shaped inner ring, here designated instead by the reference numeral 22*c*, is constricted in the outer diameter of the bottom half portion thereof, thus forming a curved portion 221C. The curved portion 221C is supported by the circular skirt portion 17 with an increased abutment area therebetween so that the sealing effect can be further increased.

In conclusion, the leakage preventive device for milk bottle according to the invention has the following advantages over the prior art.

(1) First, compared to the prior art, the leakage preventive device of the invention can more reliably prevent the milk in the bottle from leaking out no matter the bottle falls aside or is subjected to violent shaking.

(2) Second, the leakage preventive device of the invention allows the milk in the bottle to be effortlessly sucked into mouth by means of a valving action due to a negative air pressure caused by the sucking action on the teat.

(3) Third, the leakage preventive device of the invention can be used in conjunction with a conventional milk bottle and teat without having to make adaptations. Moreover, the leakage preventive device of the invention can prevent dust and bacteria from growing in the teat, allowing the milk bottle to be always clean to use.

(4) Fourth, all the constituent parts of the leakage preventive device of the invention can be dismantled for cleaning, allowing the milk bottle using the leakage preventive device of the invention to be always clean to use.

(5) Fifth, the leakage preventive device of the invention is simple in structure, allowing it to be easy to manufacture and use.

(6) Sixth, the leakage preventive device of the invention can provide a more reliable valving effect to the milk in the bottle as compared to the prior art.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A leakage preventive device for use on a bottle having a teat for the purpose of preventing liquid in the bottle from leaking out, which comprises:

a mounting device disposed between the bottle and the teat, the mounting device including a cylindrical body having a hollowed inside serving as a passage for the liquid contained in the bottle; and, an elastic valve member mounted on the mounting device, the elastic valve member having an outer wall, which is fitted tightly to an outer wall of the cylindrical body of the mounting device and a substantially U-shaped inner ring, which is linked to the outer wall of the valve member; a top face of the elastic valve member which is formed with at least one vent which allows the liquid passing through the hollowed inside of the cylindrical body of the mounting device to pass therethrough to a hole of the teat, the U-shaped inner ring being made from an elastic material, urging the U-shaped inner ring forcibly against an inner wall of the cylindrical body when the teat is not being sucked, the U-shaped inner ring having an open end to define a chamber communicating with the teat;

wherein when the teat is being sucked, it causes a negative air pressure within the chamber to cause the U-shaped inner ring to be compressed inwards, thereby forming a gap between the U-shaped inner ring and the inner wall of the cylindrical body to allow the liquid in the bottle to flow therethrough to the teat.

2. The leakage preventive device of claim 1, wherein the U-shaped inner ring has a closed bottom end.

3. The leakage preventive device of claim 2, wherein the closed bottom end of the U-shaped inner ring is formed into substantially a circular shape.

4. The leakage preventive device of claim 1, wherein a circular portion is inwardly formed in the inner wall of the cylindrical body, allowing a circular gap to be formed between the U-shaped inner ring of the elastic valve member and the inner wall of the cylindrical body of the mounting device.

5. The leakage preventive device of claim 1, wherein the cylindrical body is formed with a circular skirt portion which is protruded inwards to allow a circular gap to be formed between the cylindrical body and the U-shaped inner ring.

6. The leakage preventive device of claim 5, wherein the part of the U-shaped inner ring that comes into abutment on the circular skirt portion is formed in such a manner as to be recessed inwards with respect to a center portion of the U-shaped inner ring.

7. The leakage preventive device of claim 5, wherein an outer diameter of the U-shaped inner ring is smaller than an inner diameter of the cylindrical body, but greater than an inner diameter of the circular skirt portion.

8. The leakage preventive device of claim 5, wherein the U-shaped inner ring further comprises a curved portion on a lower end thereof, the curved portion coming into abutment with, and being supported by, the circular skirt portion of the cylindrical body.

9. The leakage preventive device of claim 1, wherein the outer wall of the valve member has a tapered bottom which is fitted into a recessed portion formed in the mounting device.

* * * * *